US008776687B2

(12) United States Patent
Nam et al.

(10) Patent No.: US 8,776,687 B2
(45) Date of Patent: Jul. 15, 2014

(54) DEVICE AND METHOD FOR FORMING THIN FILM PATTERN

(75) Inventors: Seung-Hee Nam, Paju-si (KR); Tae-Hyoung Moon, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 277 days.

(21) Appl. No.: 12/912,470

(22) Filed: Oct. 26, 2010

(65) Prior Publication Data

US 2011/0155004 A1 Jun. 30, 2011

(30) Foreign Application Priority Data

Dec. 30, 2009 (KR) ..... 10-2009-0134812

(51) Int. Cl.
*B41F 1/16* (2006.01)
*B41L 23/00* (2006.01)

(52) U.S. Cl.
USPC ..... 101/492; 101/148; 101/484

(58) Field of Classification Search
USPC ..... 101/147, 148, 484, 492
See application file for complete search history.

(56) References Cited

U.S. PATENT DOCUMENTS

| | | | | |
|---|---|---|---|---|
| 5,992,317 | A * | 11/1999 | Hummel et al. | 101/148 |
| 6,566,039 | B1 * | 5/2003 | Teng | 430/302 |
| 2008/0000374 | A1 * | 1/2008 | Kim et al. | 101/425 |

FOREIGN PATENT DOCUMENTS

| | | | |
|---|---|---|---|
| CN | 101093353 | A | 12/2007 |
| EP | 2 062 729 | | 5/2009 |
| JP | 2002-66391 | A | 3/2002 |
| KR | 10-2007-0080986 | A | 8/2007 |
| KR | 10-2007-0121165 | | 12/2007 |
| KR | 10-2009-0127694 | A | 12/2009 |

* cited by examiner

*Primary Examiner* — Ren Yan
(74) *Attorney, Agent, or Firm* — McKenna Long & Aldridge LLP

(57) ABSTRACT

The present invention provides device and method for forming a thin film pattern which can maintain an extent of wetting of a printing liquid at a proper state without time dependence. The device for forming a thin film includes a printing liquid supply unit for supplying printing liquid, a cliché having a depressed pattern and a relieved pattern for patterning the printing liquid, a printing roller for having the printing liquid supplied from the printing liquid supply unit thereto coated thereon and being rolled on the cliché and the substrate, and a solvent supply unit for supplying a solvent to the printing liquid before the printing liquid coated on the printing roller is brought into contact with the cliché.

4 Claims, 9 Drawing Sheets

<one side of a cliché>

<other side of a cliché>

DEVICE AND METHOD FOR FORMING THIN FILM PATTERN

CROSS REFERENCE TO RELATED APPLICATION

This application claims the benefit of the Patent Korean Application No. 10-2009-0134812, filed on Dec. 30, 2009, which is hereby incorporated by reference as if fully set forth herein.

BACKGROUND OF THE DISCLOSURE

1. Field of the Disclosure

The present invention relates to device and method for forming a thin film pattern which can maintain an extent of wetting of a printing liquid at a proper state without time dependence.

2. Discussion of the Related Art

Recently, various kinds of flat display devices have been developed, which can reduce weight and volume that are disadvantages of a cathode ray tube. In the flat display devices, there is a liquid crystal display device, a field emission display device, a plasma display panel, an electroluminescence EL display device, and so on.

The flat display device is provided with a plurality of thin films formed by a mask process including a deposition step, an exposure step, a development step, an etching step, and so on. However, since the mask process has a complicate fabrication process, the mask process increases a production cost. Consequently, researches for forming the thin film by using a printing process utilizing a printing roller are under progress.

The printing process is a process in which a printing liquid is coated on a blanket on the printing roller, a printing pattern is formed on the printing roller by using a cliché, and the printing pattern is transcribed to a substrate, thereby forming a desired thin film.

An extent of dry of the printing liquid coated on the printing roller has time dependence such that a shape of the printing liquid formed on the cliché varies with the extent of dry. That is, the extent of dry of the printing liquid formed on the printing roller varies with positions on the cliché. Since one side of the cliché 30 is brought into contact with the printing roller 10 at an initial stage as shown in FIG. 1A, though the printing liquid 20 on the printing roller 10 is transcribed to the cliché 10 properly, since the other side of the cliché 30 is brought into contact with the printing roller 10 later than the one side of the cliché 30 as shown in FIG. 1B, dropping viscosity of the printing liquid formed on the printing roller 10, the printing liquid 20 can not be transcribed from the printing roller 10 to the cliché 10, properly. The failure of proper transcription of the printing liquid 20 from the printing roller 10 to the cliché 30 causes defective thin film formed on the substrate when the substrate is brought into contact with the printing roller 10. According to this, as shown in FIG. 2, since the thin film pattern varies with positions on the substrate 1, uniformity of the thin film pattern becomes poor.

SUMMARY OF THE DISCLOSURE

Accordingly, the present invention is directed to device and method for forming a thin film pattern.

An object of the present invention is to provide device and method for forming a thin film pattern which can maintain an extent of wetting of a printing liquid at a proper state without time dependence.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for forming a thin film includes a printing liquid supply unit for supplying printing liquid, a cliché having a depressed pattern and a relieved pattern for patterning the printing liquid, a printing roller for having the printing liquid supplied from the printing liquid supply unit thereto coated thereon and being rolled on the cliché and the substrate, and a solvent supply unit for supplying a solvent to the printing liquid before the printing liquid coated on the printing roller is brought into contact with the cliché.

The solvent supply unit includes a liquid container having a solvent stored therein, and at least one solvent supply roller for supplying the solvent to the printing liquid.

The solvent supply unit supplies a vapor state solvent to the printing liquid after turning the solvent into the vapor state.

In another aspect of the present invention, a method for forming a thin film pattern includes the steps of coating and drying a printing liquid on a printing roller, supplying a solvent to the printing liquid coated on the printing roller by using a solvent supply unit before the printing roller is rolled on a cliché having a depressed pattern and a relieved pattern, patterning the printing liquid by rolling the printing roller on the cliché, and transcribing a thin film pattern formed by patterning thus to a substrate.

The step of supplying a solvent to the printing liquid includes the steps of providing a liquid container having the solvent stored therein, and supplying the solvent from the liquid container to the printing liquid by using at least one solvent supply roller.

The step of supplying a solvent to the printing liquid includes the step of supplying a vapor state solvent to the printing liquid after turning the solvent into the vapor state.

The solvent supply unit supplies a high boiling point solvent to the printing liquid when viscosity of the printing liquid is not within an allowable range.

The high boiling point solvent is formed of PGMEA or PC.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1A:
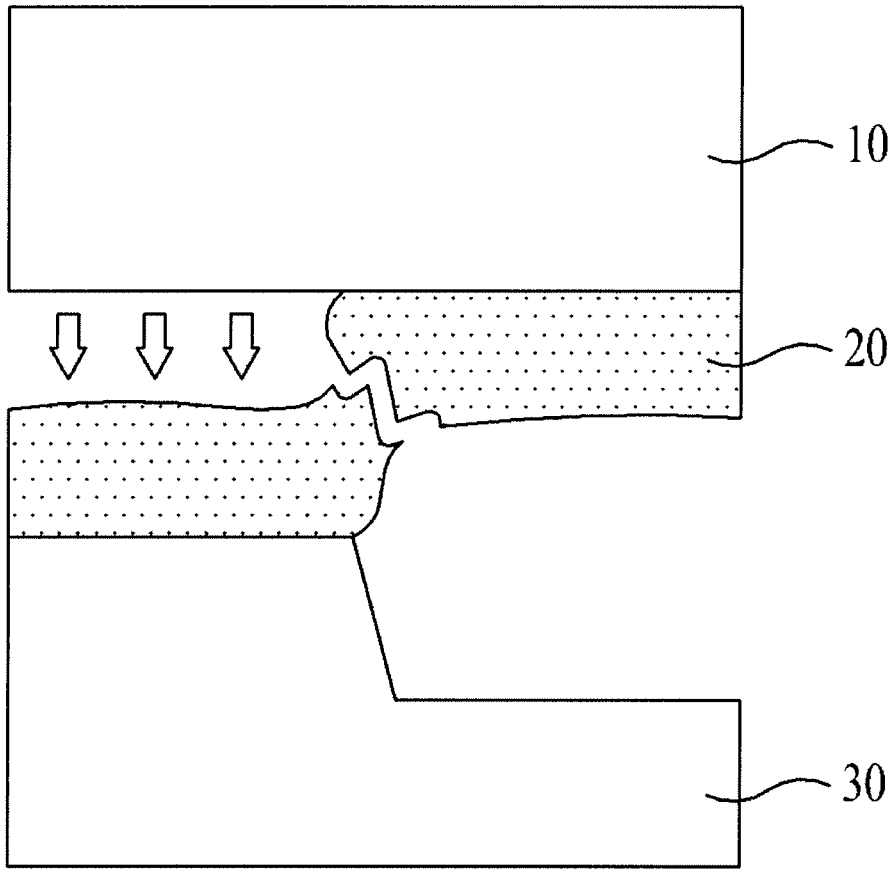
FIG.1A Related Art
FIGS. 1A and 1B illustrate sections showing transcription of a printing liquid of an extent of dry varied with time to a cliché.
Figure 1B:
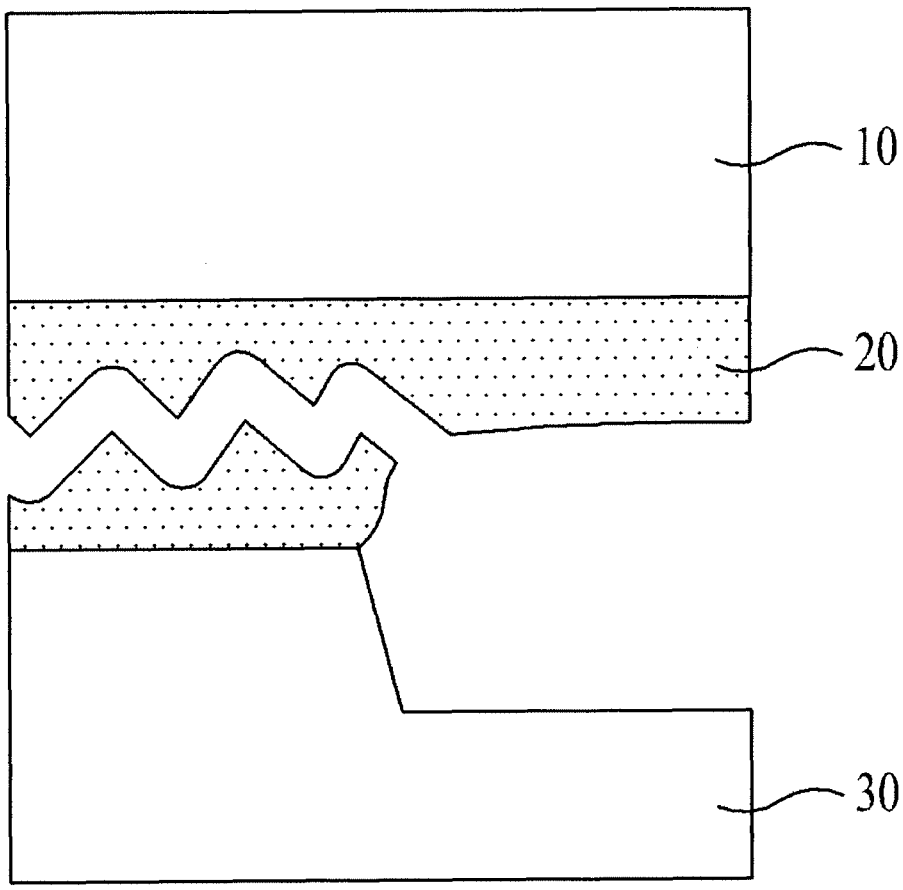
FIG.1B Related Art
Figure 2:
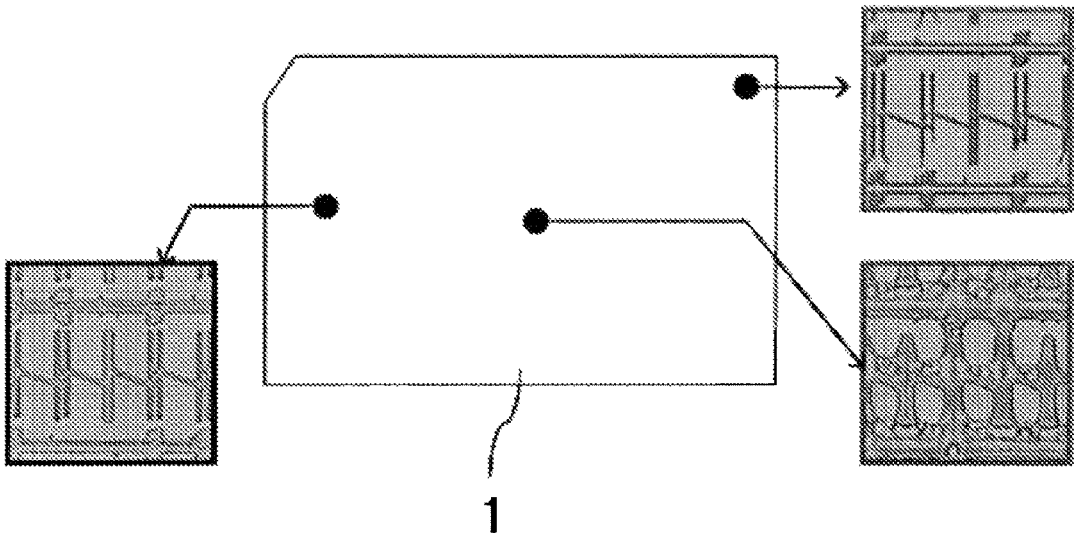
FIG. 2 illustrates a plan view for explaining pattern non-uniformity appeared on an entire surface of the panel come from the extent of dry varied with the positions in FIGS. 1A and 1B.
Figure 3:
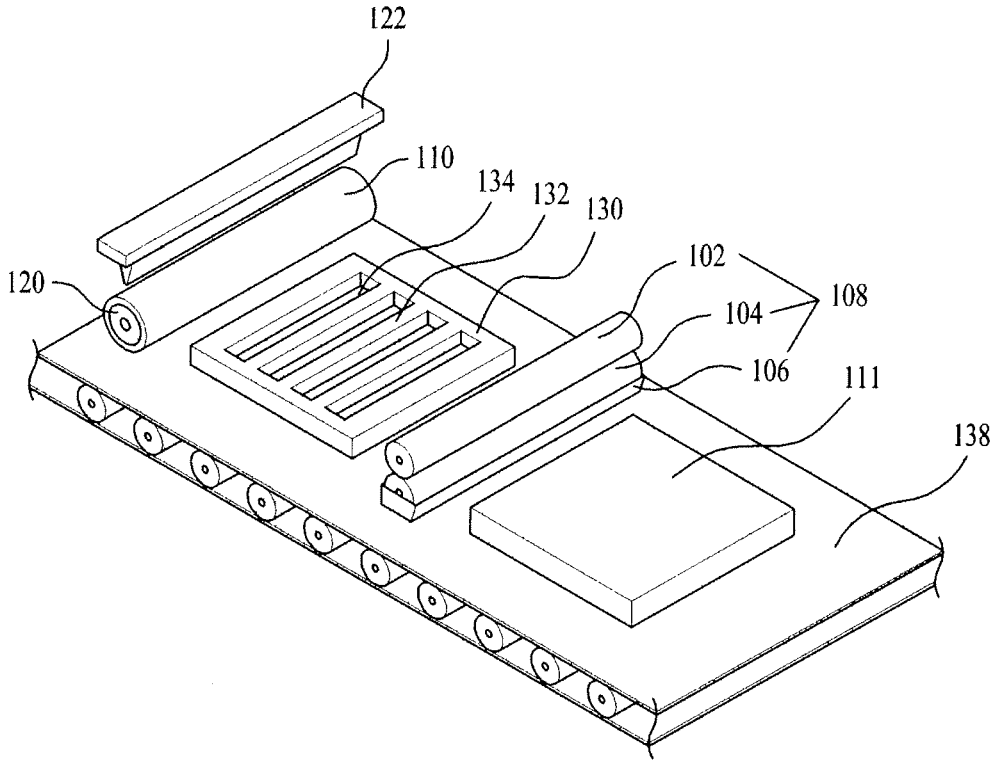
FIG. 3 illustrates a perspective view of a device for forming a thin film pattern in accordance with a preferred embodiment of the present invention.

FIG. 3 illustrates a perspective view of a printing device for forming a thin film pattern in accordance with a preferred embodiment of the present invention.

Referring to FIG. 3, the printing device includes a printing liquid supply unit 122, a printing roller 120, a blanket 110, a cliché 130, and a solvent supply unit 108.

The printing liquid supply unit 122 holds the printing liquid for supplying the printing liquid to the blanket 110 on the printing roller 120. In this instance, the printing liquid is, for an example, a material of a thin film pattern included to a color filter substrate and a thin film transistor substrate of a liquid crystal panel. The printing liquid consists of, for an example, about 20~30% of a base polymer, about 70~80% of a low boiling point solvent, and about 0~10% of a high boiling point solvent. The low boiling point solvent is methanol or alcohol, and used for dropping viscosity of the printing liquid to make the printing liquid to be coated on the blanket 110 of the printing roller 120 uniformly and to be volatile right after the coating on the blanket 110. The high boiling point solvent consists of PGMEA (Propylene Glycol Monomethyl Eter Acetate) and/or PC (Proplyene Carbonate). In this instance, since the high boiling point solvent is added before the printing liquid coated on the printing roller 120 is brought into contact with the cliché 130, the high boiling point solvent is contained to the printing liquid less than the related art.

The cliché 130 is brought into contact with the printing roller 120 such that the printing liquid filled in the blanket 110 of the printing roller 120 is left only at desired areas. To do this, the cliché 130 includes a depressed pattern 134 and a relieved pattern 132. When the printing roller 120 rolls on the cliché 130, the relieved pattern 132 is brought into contact with the printing liquid coated on the printing roller 120. According to this, when the printing roller 120 rolls on the cliché 130, the printing liquid is transcribed from the printing roller 120 to the relieved pattern 132. However, even if the printing roller 120 rolls on the cliché 130, the depressed pattern 134 is not brought into contact with the printing liquid on the printing roller 120. According to this, the printing liquid on the printing roller 120 matched to the depressed pattern 134 is remained on the printing roller 120 to form an organic pattern.

The printing roller 120 rolls on the cliché 130 and the substrate 111 which move on a transfer unit 138 such that the printing roller 120 is brought into contact with the cliché 130 and the substrate 111 in succession. Or, alternatively, the printing roller 120 may roll to move on the cliché 130 and the substrate 111 in a state the cliché 130 and the substrate 111 are stationary such that the printing roller 120 is brought into contact with the cliché 130 and the substrate 111 in succession.

The printing roller 120 fills the printing liquid from the printing liquid supply unit 122 to the blanket 110 attached to an outside circumference of the printing roller 120.

The solvent supply unit 108 includes a liquid container 106 and at least one solvent supply roller 102 and 104.

The liquid container 106 has the high boiling point solvent consisting of PGMEA (Propylene Glycol Monomethyl Eter Acetate) and/or PC (Proplyene Carbonate) stored therein.

The at least one solvent supply roller 102 and 104 supplies a solvent from the liquid container 106 to the printing liquid coated on the printing roller 120. The present invention will be described, taking an example in which the printing device includes two solvent supply rollers.

The first solvent supply roller 102 receives the high boiling point solvent from the second solvent supply roller 104, and transfers the same to the printing roller 120. In detail, the first solvent supply roller 102 supplies the high boiling point solvent to the printing liquid coated on the printing roller 120 according to viscosity of the printing liquid before the printing liquid coated on the printing roller 120 is brought into contact with the cliché 130. That is, when the viscosity of the printing liquid coated on the printing roller 120 is not within an allowable range of viscosity, the first solvent supply roller 102 supplies the high boiling point solvent to the printing liquid coated on the printing roller 120. When the viscosity of the printing liquid coated on the printing roller 120 is within the allowable range of viscosity, the first solvent supply roller 102 does not supply the high boiling point solvent to the printing liquid.

In detail, since the viscosity of the printing liquid coated on the printing roller 120 which is brought into contact with one side of the cliché 130 at the initial stage is within the allowable range of the viscosity, no high boiling point solvent is supplied to the printing liquid. Opposite to this, since the other side of the cliché 130 is brought into contact with the printing roller later than the one side of the cliché 130, the viscosity of the printing liquid coated on the printing roller 120 is low, relatively. Therefore, since the viscosity of the printing liquid coated on the printing roller 120 is not within the allowable range of viscosity, the high boiling point solvent is supplied to the printing liquid.

The second solvent supply roller 104 transfers the high boiling point solvent from the liquid container 106 to the first solvent supply roller 102. The second solvent supply roller 104 rotates engaged with the first solvent supply roller 102 to make the high boiling point solvent coated on the first solvent supply roller 102, uniformly.

Figure 4:
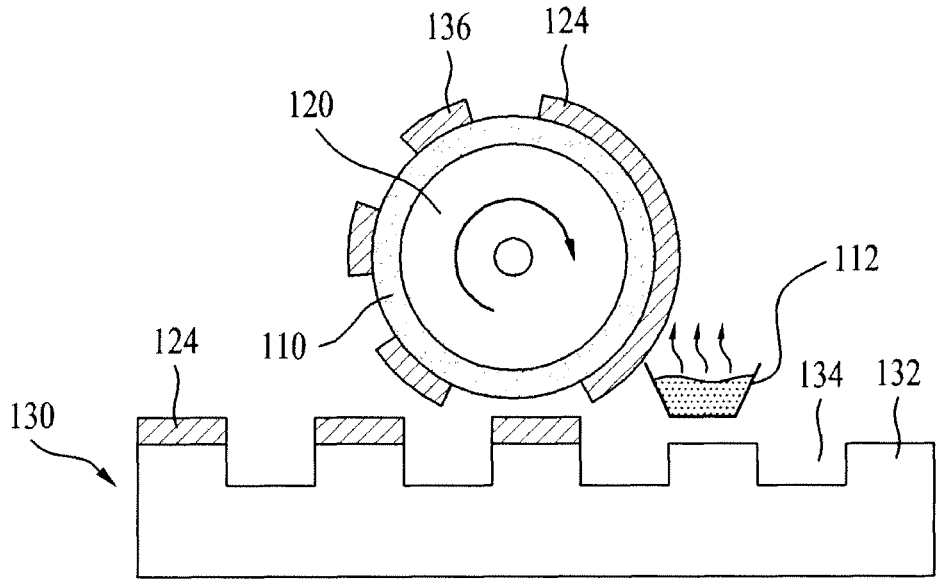
FIG. 4 illustrates a section of the solvent supply unit in FIG. 3 in accordance with another preferred embodiment of the present invention.

Referring to FIG. 4, a solvent vapor supply unit 112 supplies a vapor state solvent to the printing liquid coated on the printing roller 120.

Figure 5:
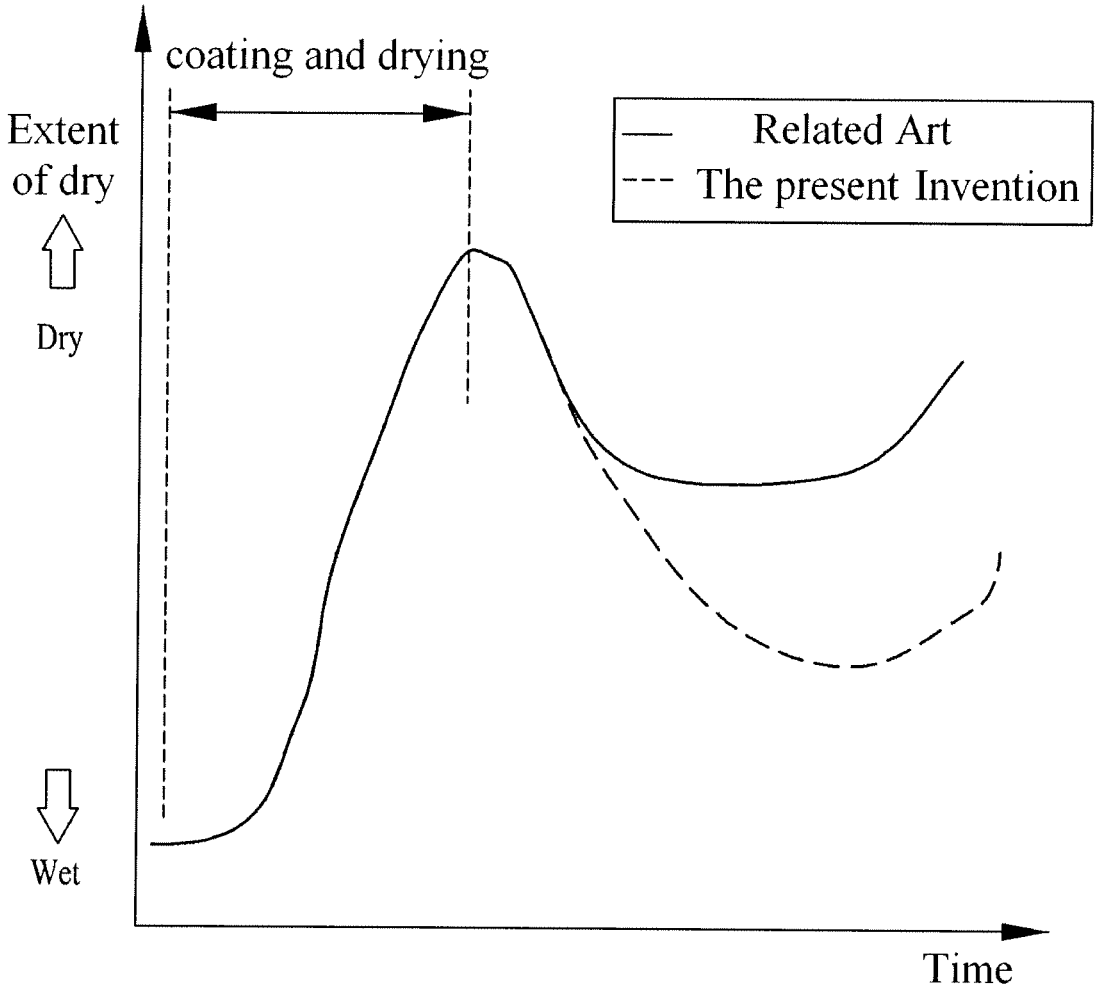
FIG. 5 illustrates a graph showing extents of dry of the printing liquid in the related art and the present invention.

Thus, in the printing device of the present invention, the printing roller 120 rotates while the printing roller 120 is in contact with the solvent supply unit 108 before the printing liquid is brought into contact with the cliché 130. According to this, as shown in FIG. 5, while the printing liquid is dried as time passes in the related art, the printing liquid maintains a proper wetting state even if time passes in the present invention. Thus, the printing device of the present invention can improve the uniformity of the thin film pattern as the extent of dry of the printing liquid is determined according to an extent of wetting of the printing liquid and a contact time period of the printing liquid with the solvent supply unit without time dependence.

Figure 6A:
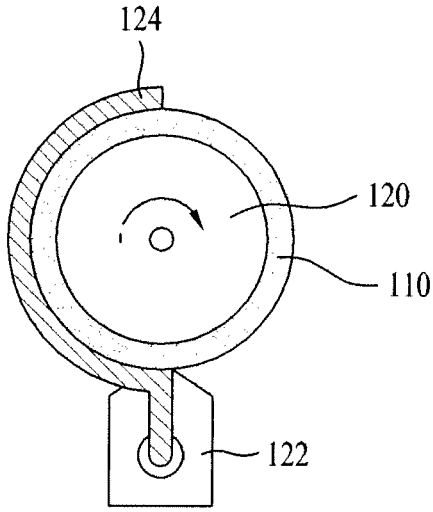
FIGS. 6A to 6C illustrate sections showing the steps of a method for forming a thin film pattern on a substrate by using the blanket in FIG. 3.
Figure 6B:
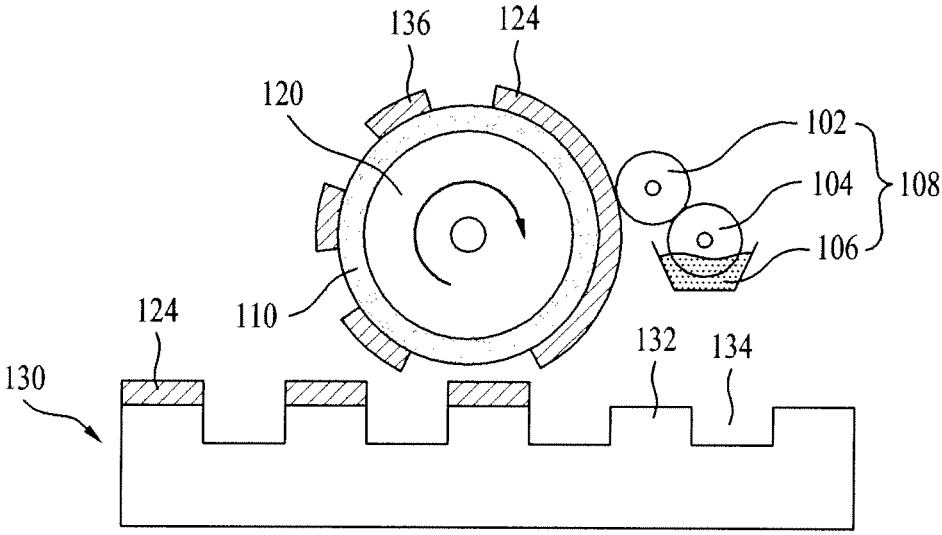
Figure 6C:
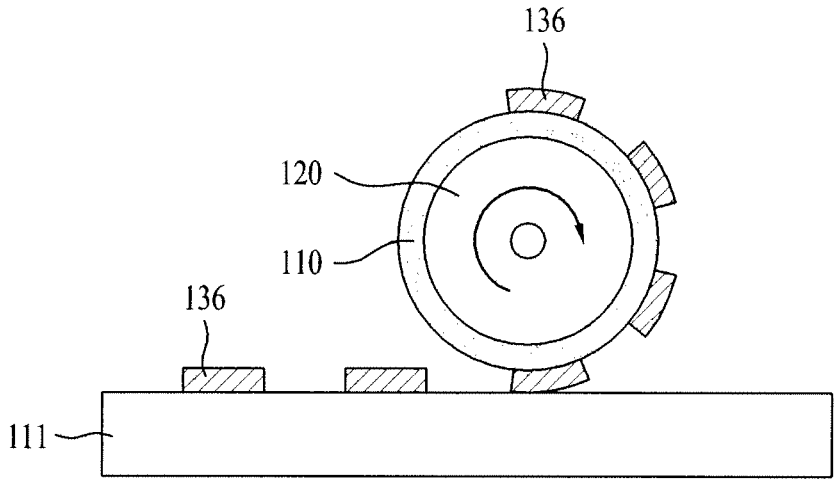

FIGS. 6A to 6C illustrate sections showing the steps of a method for patterning a thin film by using printing roller having the blanket attached thereto.

Referring to FIG. 6A, after coating a printing liquid 124 on a printing roller 120 having the blanket 110 attached thereto, the printing liquid is dried, fully or in a saturated state.

Then, before the printing liquid 124 is brought into contact with the cliché 130, a high boiling point solvent is supplied to the printing liquid 124 on the printing roller 120 which is rotating by the first solvent supply roller 102 of the solvent supply unit 108. Then, the printing roller 120 having the printing liquid 124 coated thereon is rolled on the cliché 130 having a depressed pattern 134 and a relieved pattern 132.

The printing liquid 124 at a region which is brought into contact with the relieved pattern 132 is transcribed to the relieved pattern 132, and the printing liquid 124 which is not brought into contact with depressed pattern 134 is left on a surface of the blanket 110, to form a printing pattern 136.

Referring to FIG. 6C, the printing roller 120 having the printing pattern 136 formed thereon is rolled on the substrate 111. According to this, the printing pattern 136 is transcribed to the substrate 111, dried and cured to form a thin film pattern.

In the meantime, the printing device of the present invention can form a thin film or a thick film, not only on the liquid crystal panel, but also on a flat display device, such as a plasma display panel, an electroluminescence EL display panel, a field emission display device, or the like.

Figure 7:
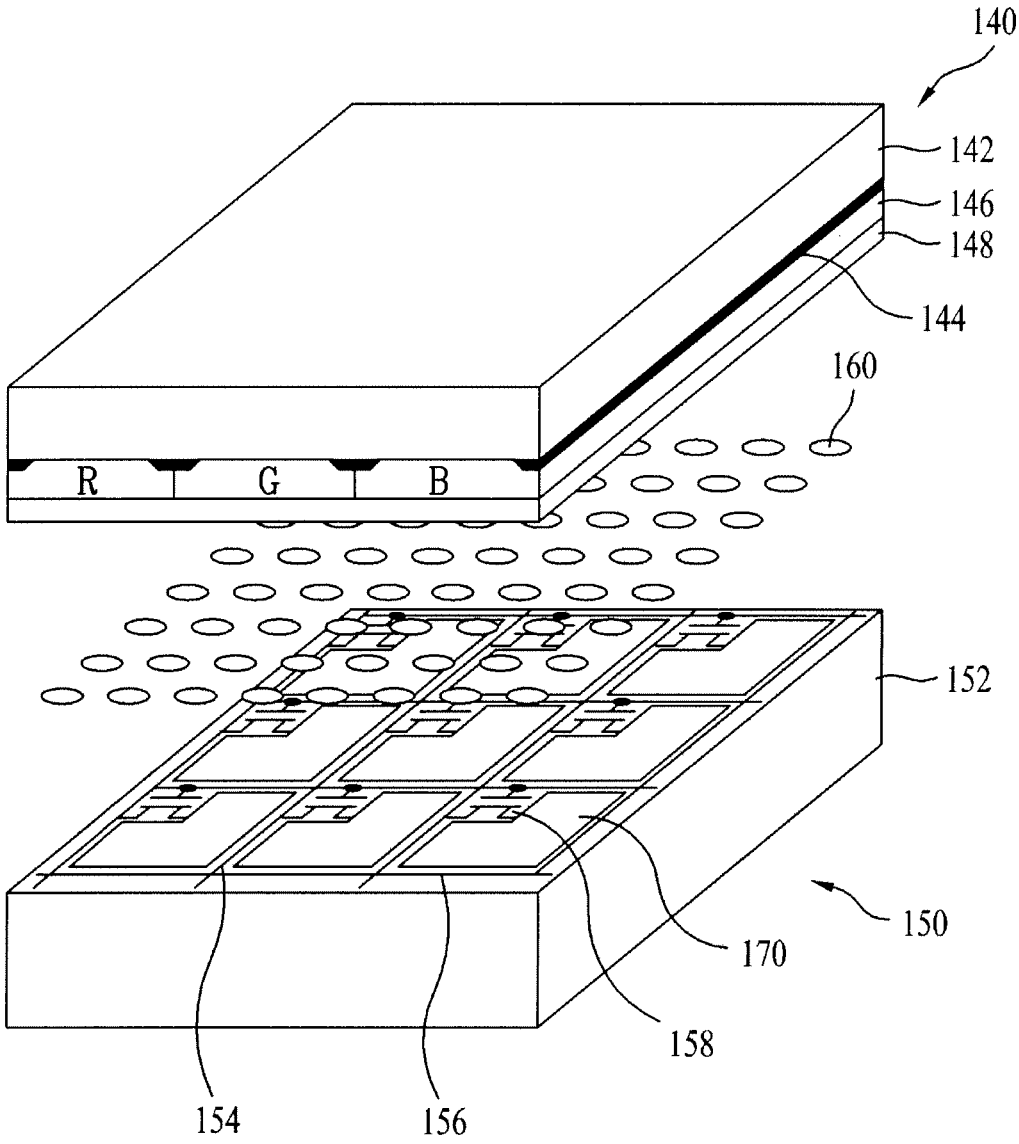
FIG. 7 illustrates a perspective view of a liquid crystal panel having the thin film pattern formed by the method in FIGS. 6A to 6C.

In detail, referring to FIG. 7, the liquid crystal panel of the present invention includes a thin film transistor substrate 150 and a color filter substrate 140 bonded opposite to each other with a liquid crystal layer 160 disposed therebetween.

The color filter substrate 140 includes a black matrix 144, a color filter 146, a common electrode 148, column spacers (not shown) formed on an upper substrate 142 in succession.

The thin film transistor substrate 150 includes gate lines 156 and data lines 154 formed to cross each other, thin film transistor 158 formed adjacent to every crossing portion thereof, and a pixel electrode 170 formed at every pixel region formed by the crossed structure.

The printing process of the present invention can form a thin film pattern of an organic material, such as the color filter 146, the black matrix or the column spacers of the liquid crystal panel, and an organic pattern used as a mask for patterning a thin film of an inorganic material, such as the thin film transistor 158, the gate lines 156, the data lines 154, or the pixel electrodes 170 of the liquid crystal panel.

As has been described, the device and method for forming a thin film pattern of the present invention have the following advantages.

The contact of the printing roller to the solvent supply unit while the printing roller rolls before the printing liquid is brought into contact with the cliché permits to maintain a proper wetting state of the printing liquid. According to this, the device and method of the present invention can improve uniformity of the thin film pattern as the extent of dry of the printing liquid is determined according to an extent of wetting of the printing liquid and a contact time period of the printing liquid with the solvent supply unit without time dependence and can improve a process stability since the process has no time dependence. Moreover, the since the thin film pattern can be formed by using a printing roller blanket of the present invention without a photolithography, a production cost can be saved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for forming a thin film pattern comprising the steps of:

coating and drying a printing liquid on a printing roller;

supplying a solvent to the printing liquid coated on the printing roller by using a solvent supply unit before the printing roller is rolled on a cliché having a depressed pattern and a relieved pattern, wherein the solvent is mixed with the printing liquid to maintain viscosity of the printing liquid within an allowable range;

patterning the printing liquid by rolling the printing roller on the cliché; and transcribing a thin film pattern formed by patterning thus to a substrate, wherein the step of supplying a solvent to the printing liquid includes the steps of:

providing a liquid container having the solvent stored therein; and supplying the solvent from the liquid container to the printing liquid by using first and second supply rollers, and wherein the first solvent supply roller supplies the solvent to the printing liquid, and the second solvent supply roller rotates engaged with the first solvent supply roller to transfer the solvent from the liquid container to the first solvent supply roller.

2. The method as claimed in claim 1, wherein the solvent supply unit supplies a high boiling point solvent to the printing liquid when viscosity of the printing liquid is not within the allowable range.

3. The method as claimed in claim 2, wherein the high boiling point solvent is formed of PGMEA or PC.

4. A device for forming a thin film comprising:

a printing liquid supply unit for supplying printing liquid;

a cliché having a depressed pattern and a relieved pattern for patterning the printing liquid;

a printing roller for having the printing liquid supplied from the printing liquid supply unit thereto coated thereon and being rolled on the cliché and a substrate; and a solvent supply unit for supplying a solvent to the printing liquid coating on the printing roller before the printing liquid coated on the printing roller is brought into contact with the cliché, wherein the solvent is mixed with the printing liquid to maintain viscosity of the printing liquid within an allowable range;

wherein the solvent supply unit includes:

a liquid container having a solvent stored therein;

a first solvent supply roller for supplying the solvent to the printing liquid; and a second solvent supply roller for rotating engaged with the first solvent supply roller to transfer the solvent from the liquid container to the first solvent supply roller.

* * * * *